US008291740B2

(12) United States Patent
Ishimori et al.

(10) Patent No.: US 8,291,740 B2
(45) Date of Patent: Oct. 23, 2012

(54) HOT FORMING DIE, PRESS FORMING APPARATUS, AND HOT PRESS FORMING METHOD

(75) Inventors: Yuuichi Ishimori, Chiba (JP); Tetsuo Shima, Chiba (JP)

(73) Assignee: Nippon Steel Corporation, Tokyo (JP)

( * ) Notice: Subject to any disclaimer, the term of this patent is extended or adjusted under 35 U.S.C. 154(b) by 1085 days.

(21) Appl. No.: 12/281,420

(22) PCT Filed: Mar. 1, 2007

(86) PCT No.: PCT/JP2007/053936
§ 371 (c)(1),
(2), (4) Date: Sep. 2, 2008

(87) PCT Pub. No.: WO2007/100053
PCT Pub. Date: Sep. 7, 2007

(65) Prior Publication Data

US 2009/0013749 A1 Jan. 15, 2009

(30) Foreign Application Priority Data

Mar. 2, 2006 (JP) ..... 2006-055796

(51) Int. Cl.
*B21D 37/16* (2006.01)

(52) U.S. Cl. ..... 72/342.5; 72/342.6

(58) Field of Classification Search ..... 72/201, 72/342.2, 342.5, 342.6, 364
See application file for complete search history.

(56) References Cited

U.S. PATENT DOCUMENTS 1,580,931 A * 4/1926 Thackray ..... 72/342.6
2,171,461 A * 8/1939 Tideman ..... 72/419
3,691,813 A * 9/1972 Matthews et al. ..... 72/342.2
3,998,084 A * 12/1976 Rerecich ..... 72/201
(Continued)

FOREIGN PATENT DOCUMENTS

JP 10-85562 4/1998
(Continued)

OTHER PUBLICATIONS

English language International Search Report for International Application No. PCT/JP2007/053936 filed Mar. 1, 2007.
(Continued)

*Primary Examiner* — Edward Tolan
(74) *Attorney, Agent, or Firm* — Dorsey & Whitney LLP

(57) ABSTRACT

A hot forming die according to an exemplary embodiment can be provided for a press forming apparatus which can press-forms a heated metal plate (e.g., a work material) and may cool the work material by ejecting a cooling medium onto the work material. The hot forming die can have a main supply path through which the cooling medium passes, a plurality of branch supply paths branching off the main supply path, injection ports for ejecting the cooling medium to the outside of the die, and nozzle members fixed on the ejection port side of the branch supply paths to restrict the passage amount of the cooling medium by using passage holes for allowing the cooling medium to pass there through. In a hot press forming method according to an exemplary embodiment, the cooling medium in the die can be held on standby after being pressurized to a degree at which the cooling medium is not ejected. The cooling medium according to an exemplary embodiment may be further pressurized to a pressure higher than the pressure at the standby time at predetermined timing during or after pressing and then is ejected onto the work material.

6 Claims, 4 Drawing Sheets

U.S. PATENT DOCUMENTS

| | | | | | |
|---|---|---|---|---|---|
| 4,005,591 | A | * | 2/1977 | Werner | 72/75 |
| 4,068,705 | A | * | 1/1978 | Cofer et al. | 164/417 |
| 4,442,689 | A | * | 4/1984 | Senatore | 72/41 |
| 4,949,813 | A | * | 8/1990 | Kidder et al. | 184/6.14 |

FOREIGN PATENT DOCUMENTS

| | | |
|---|---|---|
| JP | 2001-280217 | 10/2001 |
| JP | 2002-282951 | 10/2002 |
| JP | 2005-9672 | 1/2005 |
| JP | 2005-114117 | 4/2005 |
| JP | 2005-169394 | 6/2005 |
| JP | 2005-257030 | 9/2005 |
| JP | 2005-282507 | 10/2005 |

OTHER PUBLICATIONS

Microfilm of the specification and drawings annexed to the request of Japanese Utility Model Applicaton No. 121654/1989 (Laid-open No. 60687/1991) (Honda Motor Co., Ltd.) Jun. 14, 1991.

Korean application office action mailed Oct. 15, 2010 for Korean Patent application No. 10-2008-7024082.

* cited by examiner

HOT FORMING DIE, PRESS FORMING APPARATUS, AND HOT PRESS FORMING METHOD

CROSS-REFERENCE TO RELATED APPLICATION(S)

This application is a national stage application of PCT Application No. PCT/JP2007/053936 which was filed on Mar. 1, 2007, and published on Sep. 7, 2007 as International Publication No. WO 2007/100053 (the "International Application"). This application claims the priority from the International Application pursuant to 35 U.S.C. §365, and from Japanese Patent Application No. 2006-055796 filed Mar. 2, 2006, under 35 U.S.C. §119. The disclosures of the above-referenced applications are incorporated herein by reference in their entities.

FIELD OF THE INVENTION

The present invention relates to a hot forming die used to form a heated steel plate and a press forming apparatus equipped with the hot forming die.

BACKGROUND INFORMATION

Conventionally, to obtain automobile parts and machine parts, a method for manufacturing a formed component by press-forming a metal plate at low temperatures has been used. In the cold press forming method, however, since the metal plate has properties such that the ductility thereof lowers with increasing strength, and therefore a break (crack) is generated, it can be difficult to obtain a pressed product having an intricate shape. In addition, even for a pressed product having a simple shape, the elastic recovery (e.g., spring back) generated by the relief of residual stress after forming can pose a problem, whereby high dimensional accuracy may not be obtained in some cases.

As a technique for obtaining high-strength formed components and formed parts, which is substituted for the cold press forming method, a hot press forming method for press-forming a heated metal plate material has been known. For the metal plate material, the ductility thereof can be increased and the deformation resistance thereof is lowered by heating. Therefore, in the hot press forming method, the problems of break and spring back can often be alleviated. However, in the hot press forming method, the metal plate (e.g., the work material) should be held at a bottom dead point for a predetermined period of time, e.g., to ensure a predetermined quenching hardness. Therefore, the hot press forming method may have a problem in that the tact time is lengthened by this holding process, whereby the productivity is likely decreased.

Accordingly, when the heated metal plate is press-formed or after the heated metal plate has been press-formed, a cooling medium can be brought into contact with the metal plate (e.g., the work material) from the die side to cool the metal plate (e.g., the work material), whereby the metal plate/work material can be quenched. By this cooling process, the time for holding the metal plate/work material at the bottom dead point can be shortened, and therefore the productivity of formed component can be improved.

As a mechanism for cooling the metal plate/work material, a mechanism has been described in which a cylindrical supply path through which the cooling medium passes is provided in the die that comes into contact with the metal plate/work material, and the cooling medium is ejected from the die surface, which is an end portion of the supply path, toward the metal plate/work material. Such mechanism has been described, e.g., in Japanese Patent Application Laid-Open No. 2005-169394.

In the above-described cooling medium ejecting mechanism, a plurality of ejection ports from which the cooling medium is ejected are provided on the die surface to enhance the cooling efficiency of the formed metal plate. In addition, by branching the supply path into several paths from one supply source in which the cooling medium is stored, the cooling medium is ejected from the plurality of ejection ports.

On the other hand, Japanese Patent Application Laid-Open No. 2002-282951 describes a hot press forming apparatus in which introduction grooves for allowing the cooling medium to flow are formed in the forming surface of die. This publication also describes a technique in which the cooling medium is supplied in the state in which a punch (e.g., a male die) is at the bottom dead point, and the cooling medium comes into contact with the work material while passing through the grooves in the forming surface, whereby the work material is cooled.

Accordingly, there may be a need to address and/or overcome at least some of the deficiencies described herein above.

SUMMARY OF EXEMPLARY EMBODIMENTS OF THE INVENTION

As an exemplary mode of supply path, a flow path in which the flow path cross-sectional area thereof can be substantially constant over the entire region as described above can be provided as one example. Inevitably, the flow path cross-sectional area in such exemplary case can be relatively large because the supply path may have a shape with a high slenderness ratio from the viewpoint of later-described piercing process although depending on the size of die. In such exemplary case, unless the pressure for ejecting the cooling medium is increased more than needed to diffuse the cooling medium to all of the supply paths in an instant, the cooling medium may not be ejected from the plurality of ejection ports simultaneously with uniform force. If an attempt is made to eject the cooling medium simultaneously with uniform force, the flow rate of cooling medium can increase more than needed, and the quantity of excess cooling medium that is not used for cooling the steel plate likely increases, so that the efficiency drops. The piercing of the supply path in the die is generally performed by using a low-cost machining process using a piercing tool such as a drill.

However, an exemplary preferred relationship between the necessary cross-sectional area and the length (e.g., depth) of the supply path in the size of a general die can provide a condition that the slenderness ratio is high so that the piercing using a drill or the like may be difficult to perform. For example, the working reaction force at the time when the die is worked by being attached to various machine tools and the bending strength of the piercing tool itself against the fluctuations thereof may be insufficient, and a working condition that the tool breaks can occur, and therefore the working may becomes unable.

Attaching certain importance to an economic efficiency, if the supply path is pierced in the die under the condition that the necessary length can be pierced, e.g., by using a piercing tool having a thickness capable of obtaining a strength enough to be capable of piercing that length, a supply path having a cross-sectional area larger than necessary is provided. Therefore, the cooling medium can be inevitably used in a larger quantity than needed, so that the supply path system may become inefficient.

On the other hand, as a method that facilitates piercing under a condition that the flow path cross-sectional area is small and the slenderness ratio is high, working methods such as electrical discharge machining and electrochemical machining can also be used. However, these methods may have an industrial problem in that the working cost increases significantly as compared with the aforementioned machining.

In order to eject the cooling medium onto the metal plate (e.g., a work material) efficiently, similarly to the press forming apparatus described in Japanese Patent Application Laid-Open No. 2005-169394, only the diameter in some region on the ejection port side of the supply path formed in the die can be made smaller than the diameter in other regions thereof. In addition, a method can be thought in which, like the press forming apparatus described in Japanese Patent Application Laid-Open No. 2002-282951, after the punch has been lowered to the bottom dead point, the grooves in the forming surface are utilized as thin flow paths.

However, in the configuration described in Japanese Patent Application Laid-Open No. 2005-169394, if a trouble occurs in the supply path, the whole of the die in which the supply path is formed should be exchanged. In particular, in the construction in which the diameter of supply path changes, a trouble can occur easily in the portion in which the diameter changes. Additionally, in the configuration described in Japanese Patent Application Laid-Open No. 2002-282951, the cooling medium may not begin to be sent under pressure before the punch reaches the bottom dead point, so that a trouble of delayed start of cooling likely occurs easily.

In the case where the whole of the die in which the supply path is formed in this manner is exchanged, the exchange work can be troublesome and may also require additional expenditures.

Accordingly, one of the objects of the present invention is to provide an exemplary die in which a cooling medium can be supplied efficiently to a metal plate that has been hot press-formed and the maintenance of a mechanism for supplying the cooling medium can be accomplished easily, an exemplary forming apparatus equipped with the die, and a forming method using the die.

Exemplary embodiments of the present invention can provide a hot forming die which press-forms a heated steel plate and cools the work material by ejecting a cooling medium onto the work material. The exemplary die can provide a main supply path through which the cooling medium passes; a plurality of branch supply paths branching off the main supply path and including ejection ports for ejecting the cooling medium to the outside of the die; and nozzle members fixed on the ejection port side of the branch supply paths to restrict the passage amount of the cooling medium by using passage holes for facilitating the cooling medium to pass there through.

In this exemplary embodiment of the hot forming die, threaded parts engaging with each other are formed in the branch supply path and on the nozzle member, by which the nozzle member can be fixed in the branch supply path. In addition, by elastically deforming the nozzle member, the nozzle member can also be fixed in the branch supply path.

Further, the nozzle member can be arranged in the branch supply path so that the distance between the end face on the ejection port side of the nozzle member and the forming surface of the die is not shorter than 0.05 mm and not longer than 50 mm.

The hot forming die in accordance with exemplary embodiments of the present invention can have a first die and a second die used in combination with the first die, and may be used in a press forming apparatus together with a pressurizing means capable of controlling the pressure of cooling medium at two or more stages.

The press forming apparatus in accordance with exemplary embodiments of the present invention can be used by holding the cooling medium in the main supply path and the branch supply paths on standby after being pressurized to a degree at which the cooling medium is not ejected before the press forming, and by further pressurizing the cooling medium at predetermined timing during or after pressing to eject it.

According to further exemplary embodiments of the present invention, by increasing the supply pressure of cooling medium with a small supply amount of water from the standby stage, the cooling medium can be ejected from all of the ejection ports of die substantially at the same time at good timing, and also the cooling medium can be ejected easily from the ejection ports onto the boundary surface between the die surface and the formed component. For example, in the case where the metal plate (e.g., the work material) is cooled (e.g., quenched) by using the die in accordance with the present invention, the cooling medium can be ejected efficiently onto the metal plate (e.g., the work material), so that quenching can be performed efficiently, and therefore a formed component having high strength can be obtained.

Moreover, according to another exemplary embodiments of the present invention, the nozzle member can be removed from the branch supply path, so that the maintenance of the cooling medium ejecting mechanism can be easily accomplished.

Further, the exchanged use of a plurality of nozzle members having different hole diameters of the passage holes can easily accommodate a change in set flow rate or set pressure of the cooling medium.

These and other objects, features and advantages of the present invention will become apparent upon reading the following detailed description of embodiments of the invention, when taken in conjunction with the appended claims.

BRIEF DESCRIPTION OF THE DRAWINGS

Further objects, features and advantages of the invention will become apparent from the following detailed description taken in conjunction with the accompanying figure showing illustrative embodiment(s), result(s) and/or feature(s) of the exemplary embodiment(s) of the present invention, in which.

Figure 1:
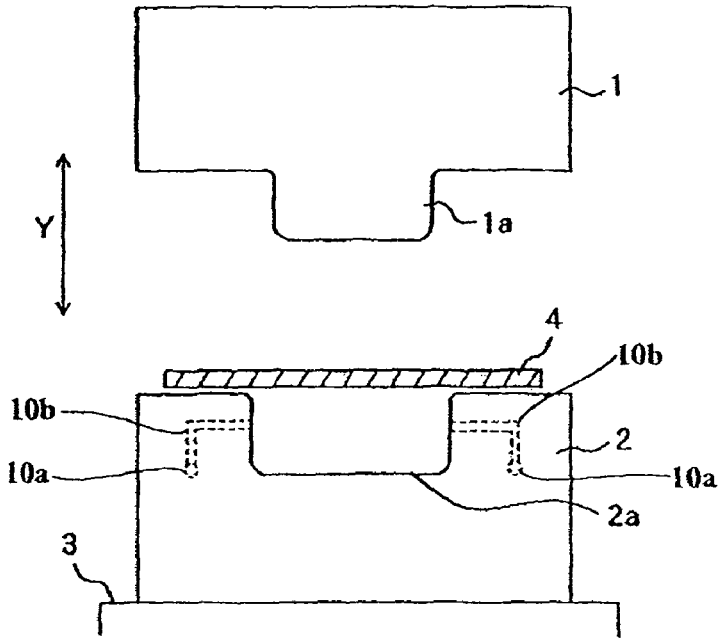
FIG. 1 is a schematic view of an exemplary embodiment of a press forming apparatus based on a first exemplary mode according to the present invention.

Throughout the figures, the same reference numerals and characters, unless otherwise stated, are used to denote like features, elements, components or portions of the illustrated embodiments. Moreover, while the present invention will now be described in detail with reference to the figures, it is done so in connection with the illustrative embodiments.

DETAILED DESCRIPTION OF EXEMPLARY EMBODIMENTS OF THE INVENTION

First Exemplary Embodiment

A first exemplary embodiment of a press forming apparatus is described below with reference to FIG. 1, which illustrates a schematic view of such exemplary press forming apparatus.

In FIG. 1, a punch 1 serving as an upper die is shown which receives a driving force sent from a driving source, not shown, by which the punch 1 can be displaced in the Y direction indicated by an arrow—the up and down direction in FIG. 1, e.g., the up and down direction of the forming apparatus. In addition, a die 2 serving as a lower die can be fixed to a plate 3. In the die 2, supply paths (e.g., a main supply path 10*a* and branch supply paths 10*b*, described herein below) through which a cooling medium passes are provided as indicated by a broken line in FIG. 1.

In the forming apparatus 5 configured as described above, a flat plate shaped metal plate 4 heated to 700° C. to 1000° C. by a heating furnace, not shown, is conveyed by a conveyance mechanism including a conveyance finger, etc. When the metal plate 4 is placed on the die 2, the punch 1 can be lowered.

When the tip end of the punch 1 comes into contact with the metal plate 4 and the punch 1 lowers further, the punch 1 presses the metal plate 4, by which the flat plate shaped metal plate is deformed along the shapes of the punch 1 and the die 2. At such time, a convex part 1*a* of the punch 1 enters into a concave part 2*a* of the die 2.

The punch 1 is displaced to a bottom dead point and is held in this state for a predetermined period of time, by which the metal plate 4 is formed into a hat shape. In addition, as described herein below, after forming, the cooling medium (e.g., water, etc.) can be ejected (e.g., for cooling) from the branch supply paths 10*b* onto the metal plate (e.g., a work material) 4 in the state in which the punch 1 is still at the bottom dead point, by which the metal plate (e.g., the work material) 4 is quenched. At such time, if the cooling medium in the main supply path and the branch supply paths can be pressurized and held on standby, the cooling medium can be supplied instantly at predetermined quenching timing. After the quenching of the metal plate (e.g., the work material) 4 has finished, the punch 1 rises and likely returns to the original state.

In the above-described exemplary forming apparatus, the configuration is such that when the metal plate 4 is press-formed, the quenching treatment is likely also performed. However, the exemplary configuration of the forming apparatus is not limited to thereto. For example, another exemplary configuration may be as follows.

First, the heated flat plate shaped metal plate 4 can be formed by another die unit, and the formed metal plate 4 may be conveyed to the forming apparatus having the configuration shown in FIG. 1. When the formed metal plate 4 is placed on the die 2, the punch 1 lowers and therefore comes into contact with the metal plate (e.g., the work material) 4. At this time, the punch 1 and the die 2 are in a state along the shape of the formed metal plate 4. In this state, the cooling medium is ejected (for cooling) onto the metal plate (e.g., the work material) 4, by which the metal plate (e.g., the work material) 4 can be quenched.

The exemplary configuration of the upper die and the lower die is not limited to the exemplary configuration shown in FIG. 1. For example, the exemplary configuration may be one shown in FIG. 2. In addition, the surface shape of die can be changed appropriately according to the shape of the formed component.

Figure 2:
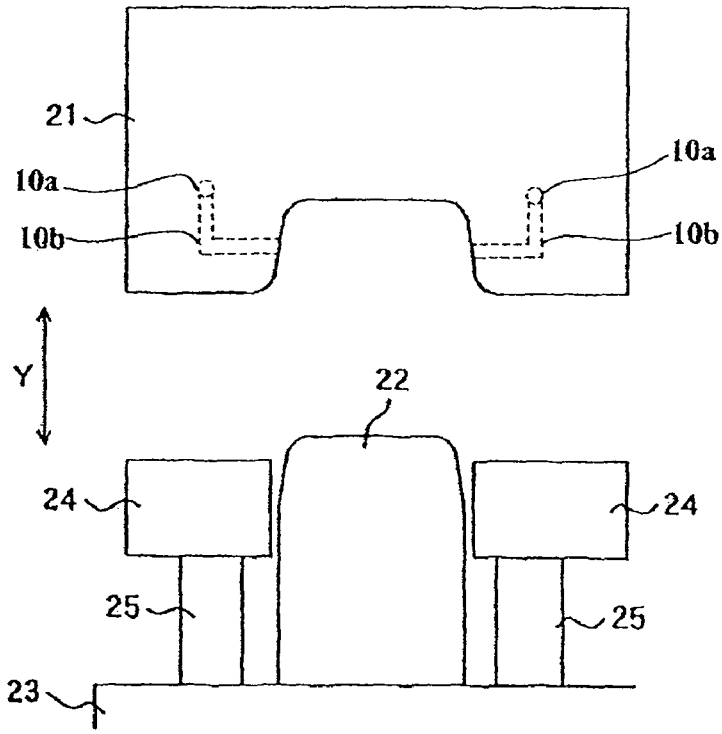
FIG. 2 is schematic view showing another mode of the exemplary embodiment of a press forming apparatus based on a second exemplary mode.

In FIG. 2, an exemplary die 21 serving as an upper die can be displaced in the Y direction indicated by an arrow. In addition, a punch 22 serving as a lower die is fixed to a plate 23. At both sides of the punch 22, blank holders 24 are arranged. Each of the blank holders 24 is supported on the plate 23 via a cushion 25.

In the exemplary configuration shown in FIG. 2, when the die 21 lowers, the blank holders 24 are pushed in by the die 21, thereby being displaced to the plate 23 side. At such time, the punch 22 can be positioned in a concave part of the die 21. By the above-described operation of the exemplary die 21, the flat plate shaped metal plate 4 can be formed into a predetermined shape.

In the exemplary die 21, the supply paths (e.g., the main supply path 10*a* and the branch supply paths 10*b*, described herein below) through which the cooling medium passes are provided as indicated by a broken line in FIG. 2. Thereby, the cooling medium can be ejected onto the formed metal plate 4, by which the metal plate (e.g., the work material) 4 can be quenched.

Figure 3:
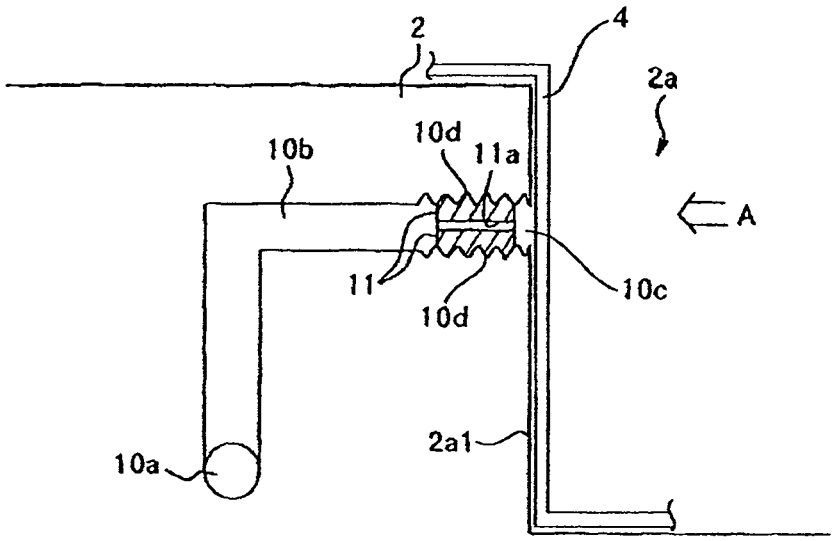
FIG. 3 is a side view showing a first exemplary embodiment a cooling medium ejecting mechanism in a die according to the present invention.
Figure 4:
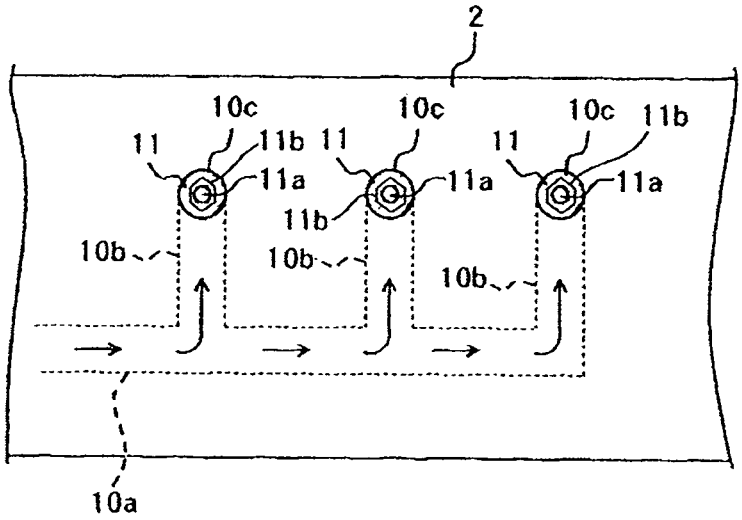
FIG. 4 is a schematic view showing of the first exemplary embodiment of the cooling medium ejecting mechanism in a die according to the present invention taken in a direction of an arrow A.

Further, a cooling mechanism for the metal plate (e.g., the work material) in the above-described exemplary forming apparatus is explained with reference to FIGS. 3 and 4. FIG. 3 shows a side view of a part of the die 2 shown in FIG. 1, e.g., the internal construction near the concave part formed in the die 2. FIG. 4 shows a schematic view taken in the direction of the arrow A in FIG. 3. The arrow marks shown in FIG. 4 denote the flow path of cooling medium.

In the exemplary die 2, the main supply path 10*a* and the plurality of (e.g., three as shown in FIG. 4) branch supply paths 10*b* branching off the main supply path 10*a* can be provided. The main supply path 10*a* may be connected to a supply source (not shown) for storing the cooling medium to introduce the cooling medium from the supply source to the branch supply paths 10*b*.

As shown in FIG. 3, the exemplary branch supply path 10*b* extends through a predetermined distance from the main supply path 10*a* toward the upper part of forming apparatus (upward in FIG. 3), and then extends toward the side wall 2*a*1 side of the concave part 2*a* of the die 2. In the side wall 2*a*1, ejection ports 10*c* formed by the branch supply paths 10*b* are provided.

Since the branch supply path 10*b* is provided in plural numbers, in the side wall 2*a*1 of the die 2, the ejection port 10*c* may be provided in a number corresponding to the number of the branch supply paths 10*b*. In addition, the number of the branch supply paths 10*b*, in other words, the number of ejection ports 10*c* can be set appropriately, and the interval of the adjacent two ejection ports 10*c* can also be set appropriately.

In a certain region (e.g., inner peripheral surface) on the ejection port 10*c* side of the branch supply path 10*b*, a threaded part 10*d* can be formed. In such region or another region (e.g., inner peripheral surface) on the ejection port 10*c* side of the branch supply path 10*b*, similar to the path 10*b*, the threaded part 10*d* may be formed.

The nozzle member 11 can be inserted in the branch supply path 10*b* as described later, and is not brought into contact with the metal plate 4. Therefore, as a material for the nozzle member 11, a material having a lower strength than the strength of the material for the die 2 can be used.

In the above-described exemplary configuration, the state shown in FIG. 3 is formed by engaging the threaded part of the nozzle member 11 with the threaded part 10*d* of the branch supply path 10*b* and by inserting the nozzle member 11 into the branch supply path 10*b*. For example, by turning the nozzle member 11, the nozzle member 11 can be inserted from the ejection port 10*c* into the branch supply path 10*b*.

Preferably, an engagement part (for example, a hexagonal socket 11*b* shown in FIG. 4) engaging with a jig used for inserting the nozzle member 11 can be provided in the end face of the nozzle member 11. For example, if the nozzle member 11 is turned by inserting a hexagonal wrench in the hexagonal socket, the nozzle member 11 can easily be inserted into the branch supply path 10*b*. The jig need not necessarily be a hexagonal wrench.

In the exemplary configuration in which the hexagonal socket is formed in the end face of the nozzle member 11, and the nozzle member 11 is fastened into the branch supply path 10*b* by using a hexagonal wrench, the region of the nozzle member 11 on the outside in the radial direction of the hexagonal socket should be provided with a strength necessary for the fastening. For example, the central part of the cross section (surface at right angles to the lengthwise direction of the passage hole 11*a*) of the nozzle member 11 does not have to be provided with the strength necessary for the fastening. Therefore, it can be desirable to form the passage hole 11*a* in the central part of the nozzle member 11. If the passage hole 11*a* is formed in the central part, there may be no fear of decreasing the fastening strength of the nozzle member 11.

The insertion position of the nozzle member 11 in the branch supply path 10*b* can be made such that the end face (the end face on the ejection port 10*c* side) of the nozzle member 11 is flush with the side wall 2*a*1 or such that the end face of the nozzle member 11 is on the inside of the die 2 from the side wall 2*a*1. For example, the insertion position of the nozzle member 11 has only to be determined so that a part of the nozzle member 11 does not project from the side wall 2*a*1 of the die 2.

It can be desirable to determine the insertion position of the nozzle member 11 so that the end face of the nozzle member 11 is arranged 0.05 mm to 50 mm far from the forming surface to allow the cooling medium to be ejected easily in the radial direction from the ejection port 10*c* to the boundary surface between the die surface and the formed component. For example, the distance between the end face on the ejection port 10*c* side of the nozzle member 11 and the die surface (e.g., the forming surface) is set so as to be not shorter than about 0.05 mm and not longer than about 50 mm.

If the above-described distance is shorter than about 0.05 mm, the viscous resistance of cooling medium decreases the effect of promoting radial ejection. In addition, if the above-described distance is longer than about 50 mm, the volume of a space formed in the ejection hole 10*c* by the forming surface of die and the end face of the nozzle member 11 can be too large, so that merely an inefficient cooling medium can be stored, and therefore the ejection efficiency of cooling medium likely decreases.

The region of the branch supply path 10*b* in which the threaded part 10*d* is formed can be determined appropriately according to the insertion position of the nozzle member 11.

FIG. 3 shows an internal exemplary internal construction of a single side wall 2*a*1 of the die 2. The other side wall can have the same or similar internal construction.

In addition, in the state in which the nozzle member 11 is inserted in the branch supply path 10*b*, the nozzle member 11 can be welded to the branch supply path 10*b*, and/or can be bonded to the contact part between the nozzle member 11 and the branch supply path 10*b* by applying an adhesive to the contact part.

In the exemplary configuration of the die 2 shown in FIGS. 3 and 4, by installing the nozzle member 11 in the vicinity of the ejection port 10*c*, the cooling medium supplied through the branch supply path 10*b* can be sprayed efficiently onto the metal plate (e.g., the work material) 4 positioned on the outside of the die 2, e.g., in the concave part 2*a* of the die 2. This exemplary ejection process is described herein as follows.

Comparing the cross-sectional area of the passage hole 11*a* in the nozzle member 11 with that of the branch supply path 10*b* in the same plane (e.g., the plane substantially at right angles to the passage direction of the cooling medium), the cross-sectional area of the passage hole 11*a* is likely smaller. Therefore, the passage amount of cooling medium can be restricted by the passage hole 11*a*, so that the pressure (e.g., the back pressure) in the region of the branch supply path 10*b* on the upstream side of the nozzle member 11 can be increased.

For example, in the branch supply path 10*b* located farthest from the supply source of cooling medium of the plurality of branch supply paths 10*b*, in certain cases, the back pressure in the path, which can be an ejection pressure preferable for ejecting the cooling medium supplied through that branch supply path 10*b*, may not be delivered by the pressure loss caused by the flow of cooling medium in the path at an intermediate portion of the die or by the outflow of cooling medium from another ejection port in an intermediate portion. In this exemplary case, the ejection amount of cooling medium supplied through that branch supply path 10*b* is likely smaller than that from other branch supply paths, or the ejection timing delays.

If the back pressure in that branch supply path 10*b* can be raised sufficiently in a short period of time so as to be equal to the back pressure of other branch supply paths, the cooling medium can be ejected uniformly at the same time, e.g., at predetermined timing from all of the branch supply paths. Therefore, an efficient cooling medium ejection may be realized.

As a result, the metal plate (e.g., the work material) can be cooled (quenched) efficiently, so that a formed component having high strength can be obtained.

In addition, in this embodiment, since the nozzle member 11 can be removed from the branch supply path 10*b*, for example, the interior of the branch supply path 10*b* can be cleaned easily in the state in which the nozzle member 11 is removed, or a trouble occurring in the branch supply path 10*b* can be checked easily. In the case where the nozzle member 11 is welded to the branch supply path 10*b* or bonded to it by using an adhesive, the welded portion must be cut or the adhesive must be removed to take out the nozzle member 11.

In as described in Japanese Patent Application Laid-Open No. 2005-169394, the supply paths are formed integrally in the die, and the diameter of supply path on the ejection port side is small. Therefore, the cleaning, etc. in the supply path can be difficult to perform, and additionally, if a trouble occurs in the portion in which the diameter is small, the whole of the die should be exchanged in certain cases.

In this exemplary embodiment, since the nozzle member 11 can be removed as described above, the above-mentioned problems can be avoided. In particular, since the die is generally formed of steel, etc., and can be rusted by the cooling medium, by removing the nozzle member 11, the rust in the main supply path 10*a* and the branch supply paths 10*b* can be removed easily.

In the exemplary case where contamination, a flaw, or the like occurs on the nozzle member 11 as well, the removed nozzle member 11 is cleaned, or only the nozzle member 11 can be exchanged, so that the maintenance is easy to accomplish. Moreover, since likely only the nozzle member 11 is exchanged, the cost for maintenance can be reduced as compared with the case where the whole of the die is exchanged.

Further, as a material for the nozzle member 11, a material having a lower strength than the strength of the material for the die 2 can be used as described above. Therefore, the passage hole 11*a* having a cross-sectional area smaller than that of the branch supply path 10*b* can be formed easily by using a drill, etc. In addition, by preparing a plurality of nozzle members 11 having different hole diameters of the passage holes 11*a* and by appropriately exchanging these nozzle members 11, the setting of the flow rate of ejected cooling medium or the setting of the ejection pressure, that is, the back pressure can be changed easily.

In this exemplary embodiment, the plurality of branch supply paths 10*b* are connected to the main supply path 10*a*, and the cooling medium must be ejected uniformly from the plurality of branch supply paths 10*b* to efficiently cool the metal plate (e.g., the work material) 4. In the construction of supply path shown in FIG. 4, in the branch supply paths 10*b*, the ejection efficiency of cooling medium likely decreases or the ejection timing of cooling medium delays in the order from the cooling medium supply source side (e.g., the left-hand side as shown in FIG. 4).

In this exemplary embodiment, by changing the modes of the nozzle members 11 inserted in the branch supply paths 10*b*, in all of the branch supply paths 10*b*, the same ejection efficiency can be achieved, and also the ejection timing of cooling medium can be made coincide.

By adjusting the pressure in each of the branch supply paths 10*b* by using the nozzle member 11, the cooling medium can be ejected uniformly from the ejection ports 10*c* as described above. By ejecting the cooling medium uniformly at the same timing from all of the ejection ports 10*c*, the cooling medium can be ejected uniformly onto the entire surface of the formed metal plate 4, so that the metal plate (e.g., the work material) 4 can be cooled (e.g., quenched) efficiently.

By efficiently cooling the formed metal plate 4 in this manner, the tact time including quenching treatment can be shortened. By shortening the tact time, the productivity of formed component can be improved.

In addition, by ejecting the cooling medium uniformly with great force from all of the ejection ports 10*c*, the cooling medium more than the necessary amount does not have to be used at the time of quenching. In a case where the cooling medium more than the necessary amount is used, a suction mechanism having a great suction force must be provided to suck this cooling medium. However, the suction mechanism for cooling medium can be simplified by restraining the use of the cooling medium more than the necessary amount as in this embodiment.

If the ejection efficiency of cooling medium differs between the plurality of branch supply paths 10*b*, the cooling medium more than the amount needed for cooling the metal plate (e.g., the work material) can be used to supply the cooling medium to the whole of the metal plate (work material). In this case, corresponding to the supply of excess cooling medium, the tact time lengthens, or the suction capacity for the cooling medium must be increased (in other words, a complicated mechanism having high suction capacity must be used).

In addition, merely by changing the nozzle members 11 different from each other, the pressures in the branch supply paths 10*b* can be adjusted easily.

Second Exemplary Embodiment

Figure 5:
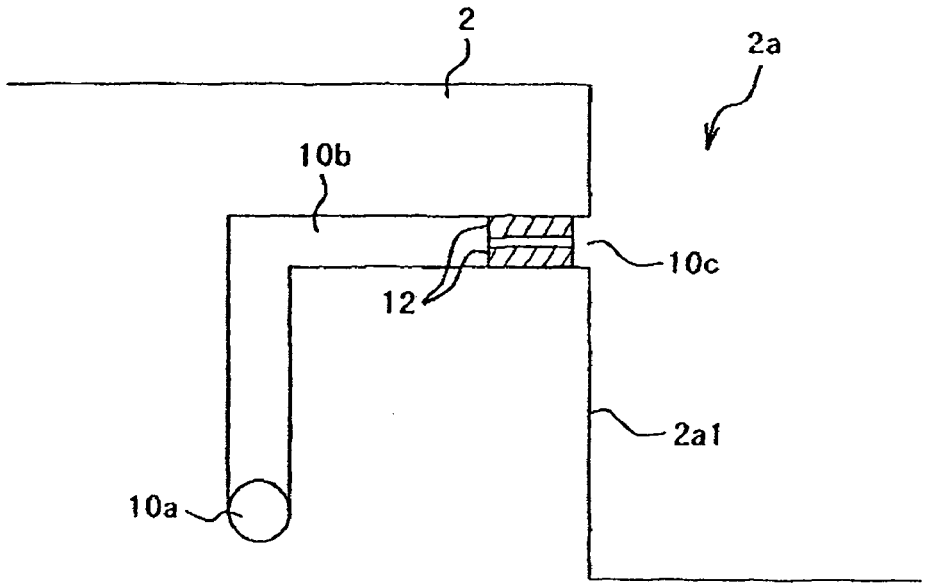
FIG. 5 is a side view showing a second exemplary embodiment of the cooling medium ejecting mechanism in a die according to the present invention.

The forming apparatus according to a second exemplary embodiment of the present invention is explained herewith with reference to FIG. 5. For example, FIG. 5 shows a part of the die 2, e.g., the internal construction near the concave part formed in the die 2.

Herein below, only portions different from those in the first exemplary embodiment are explained, and the configurations that are not explained hereunder are the same as those in the first exemplary embodiment of the forming apparatus. In the second exemplary embodiment of the forming apparatus, the exemplary configurations of the nozzle member and the branch supply path can be partially different from those in the first exemplary embodiment.

For example, a nozzle member 12 can be formed of an elastically deformable material (for example, resin, rubber, ceramics, cork, or glass), and a passage hole that is the same as that of the first exemplary embodiment is formed in the nozzle member 12. In addition, the outer peripheral surface of the nozzle member 12 has a substantially cylindrical shape.

The branch supply path 10*b* can have almost the same diameter in all regions. For example, unlike the configuration in the first exemplary embodiment, no threaded part is likely formed in the region on the ejection port 10*c* side. In addition, the diameter of the nozzle member 12 in a natural state is larger than the diameter of the branch supply path 10*b*.

In the above-described exemplary configuration, the nozzle member 12 can be inserted into the branch supply path 10*b* in a compressed state. When the nozzle member 12 is inserted, the outer peripheral surface of the nozzle member 12 is brought into force of contact with the inner surface of the branch supply path 10*b* by the restoring force of the nozzle member 12. Thereby, the nozzle member 12 may be fixed in the branch supply path 10*b*.

In this exemplary embodiment, the nozzle member 12 can be fixed at the insertion position merely by pushing the nozzle member 12 into the branch supply path 10*b* while elastically deforming it. It may be preferable that an operation part (for example, a protrusion or a concave part) for removal be provided on the end face (e.g., the end face on the ejection port 10*c* side) of the nozzle member 12 so that the nozzle member 12 can be removed easily.

The insertion position of the nozzle member 12 is the same as that explained in the First Embodiment. In addition, the nozzle member 12 may be bonded to the branch supply path 10*b* by applying an adhesive on the contact surface there between. Further, nozzle members 12 formed of different materials may be inserted into the plurality of branch supply paths 10*b*.

In this exemplary embodiment as well, the same effect as that explained in the First Embodiment can be achieved.

Third Exemplary Embodiment

Figure 6:
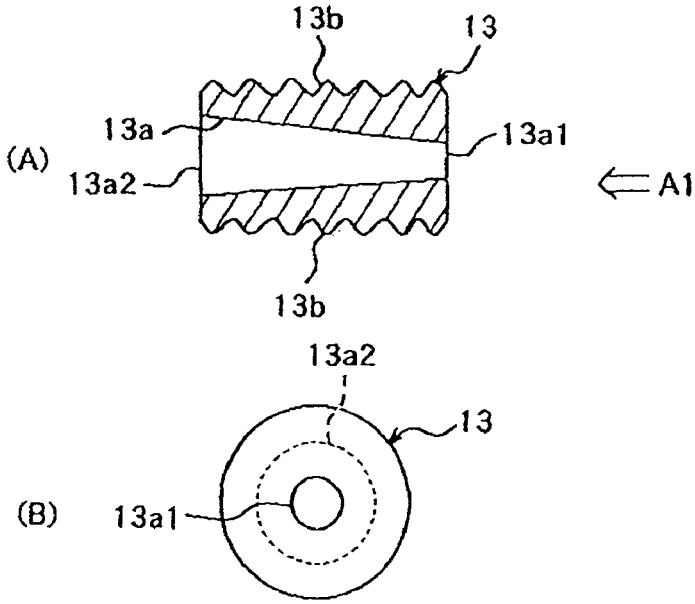
FIG. 6(A) is a sectional view of an exemplary embodiment of a nozzle member based on a first exemplary mode according to the present invention.
FIG. 6(B) is an end face view of the exemplary embodiment of the nozzle member of FIG. 6(A) according to the present invention.
Figure 7:
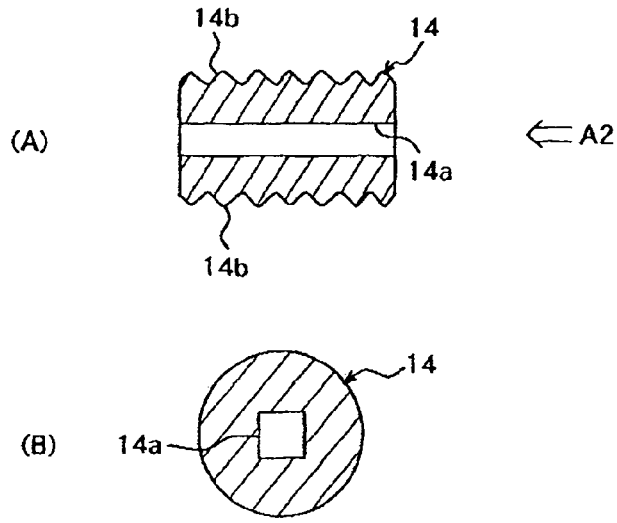
FIG. 7(A) is a sectional view of a further exemplary embodiment of the nozzle member based on a second exemplary mode according to the present invention.
FIG. 7(B) is an end face view of the exemplary embodiment of the nozzle member of FIG. 7(A) according to the present invention.

A forming apparatus according to a third exemplary embodiment of the present invention is explained with reference to FIGS. 6(A), 6(B), 7(A) and 7(B). FIG. 6(A) shows a longitudinal sectional view of an exemplary nozzle member used in this exemplary embodiment, and FIG. 6(B) shows an appearance view of the exemplary nozzle member, which is viewed from one end side (in the direction of the arrow A1 in FIG. 6(A)). FIG. 7(A) shows a longitudinal sectional view of the exemplary nozzle member in another mode of this exemplary embodiment, and FIG. 7(B) shows an appearance view of the exemplary nozzle member, which is viewed from one end side (e.g., in the direction of the arrow A2 in FIG. 7(A)).

Herein below, only portions different from those in the first exemplary embodiment are explained, and the configurations that are not explained hereunder are the same as those in the First Embodiment. In the third exemplary embodiment, the configuration of the nozzle member can likely be different from that in the first exemplary embodiment.

On the outer peripheral surface of the exemplary nozzle member 13, a threaded part 13*b* that engages with the threaded part 10*d* (e.g., as indicated in FIG. 3 showing the first exemplary embodiment) formed on the inner peripheral surface of the branch supply path 10*b* is formed. In addition, in the exemplary nozzle member 13, a passage hole 13*a* through which the cooling medium passes is formed.

The passage hole 13*a* has a tapered surface, and therefore the diameter thereof changes continuously from one end side of the nozzle member 13 toward the other side thereof.

In the above-described exemplary configuration, when the exemplary nozzle member 13 is inserted into the branch supply path 10*b*, the nozzle member 13 is inserted to a predetermined position from the largest-diameter opening part 13*a*2 side of the passage hole 13*a*. Thereby, a smallest-diameter opening part 13*a*1 of the passage hole 13*a* is located on the ejection port 10*c* side of the branch supply path 10*b*.

When the nozzle member 13 of this exemplary embodiment is used as well, the cooling medium can be ejected efficiently, so that the same effect as that explained in the first exemplary embodiment can be achieved. In the above explanation, the case where the nozzle member 13 is inserted so that the opening part 13*a*1 is on the ejection port side has been described. However, the exemplary nozzle member 13 may be inserted so that the opening part 13*a*2 is on the ejection port side.

On the other hand, for a nozzle member 14 in another mode of this exemplary embodiment, as shown in FIGS. 7(A) and 7(B), a threaded part 14*b* engaging with the threaded part formed in the branch supply path 10*b* is formed on the outer peripheral surface thereof. In addition, in the nozzle member 14, a passage hole 14*a* through which the cooling medium passes can be formed.

In this exemplary embodiment, the cross-sectional shape of the passage hole 14*a* is different from that in the first exemplary embodiment. For example, although the cross-sectional shape of the passage hole in the first exemplary embodiment is circular, in this exemplary embodiment, as shown in FIG. 7(B), the cross-sectional shape of the passage hole 14*a* can be rectangular.

For the nozzle member 14 of this exemplary embodiment as well, the passage amount of cooling medium can be restricted by the passage hole 14*a*, so that the cooling medium can be ejected efficiently. Therefore, the same effect as that explained in the first exemplary embodiment can be achieved.

Fourth Exemplary Embodiment

Figure 8:
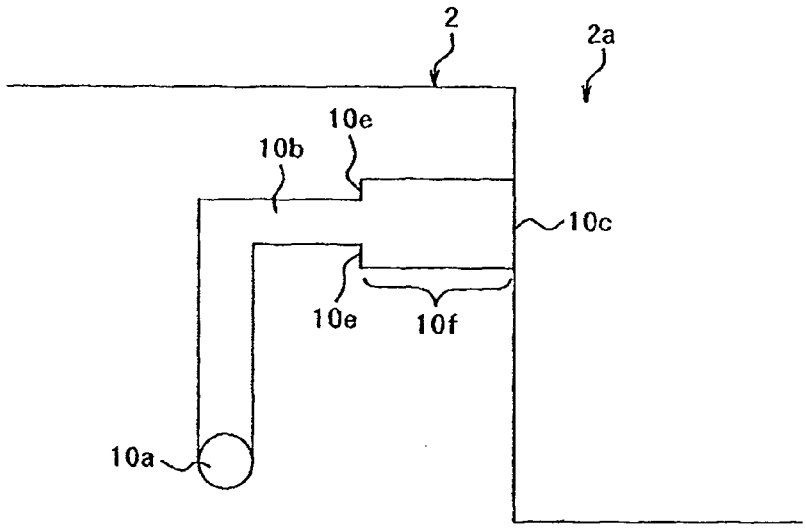
FIG. 8 is a side view showing a fourth exemplary embodiment of the cooling medium ejecting mechanism according to the present invention.

Further, a forming apparatus of a fourth exemplary embodiment in accordance with the present invention is described with reference to FIG. 8. FIG. 8 shows a part of the exemplary die 2, e.g., the internal construction near the concave part formed in the die 2.

Herein below, only portions different from those in the first exemplary embodiment are explained, and the exemplary configurations that are not explained hereunder are likely the same as those in the first exemplary embodiment. In the fourth exemplary embodiment, the exemplary configuration of the branch supply path 10*b* is different from that in the first exemplary embodiment.

In this exemplary embodiment, some region (e.g., hereinafter referred to as an expanded region) 10*f* on the ejection port 10*c* side of the branch supply path 10*b* has a diameter larger than that of other regions. In the portion in which the diameter is large, the exemplary nozzle member can be inserted.

When the nozzle member is inserted, the positioning can be performed by bringing the end face of nozzle member into contact with a cross section 10*e* of the branch supply path 10*b*. The diameter of the passage hole formed in the nozzle member is smaller than the diameter of the region other than the expanded region 10*f* of the branch supply path 10*b*.

In this exemplary embodiment, since the expanded region 10*f* is provided in the branch supply path 10*b*, the cleaning, etc. of the region on the ejection port 10*c* side of the branch supply path 10*b* can be performed easily.

In addition, since the passage amount of cooling medium is restricted by the passage hole in the nozzle member as described above, the cooling medium can be ejected efficiently. Therefore, the same effect as that explained in the first exemplary embodiment can be achieved.

In the above-described first through fourth exemplary embodiments, the case where one passage hole is formed in the nozzle member has been explained. However, the exemplary configuration may not be limited to such exemplary configuration. For example, a plurality of passage holes may be formed in the nozzle member. Additionally, in the first exemplary embodiment, the exemplary configuration in which the cooling mechanism for ejecting the cooling medium can be provided in the die 2 serving as a lower die was explained. However, a cooling mechanism that is the same as that in the first exemplary embodiment can be provided in the punch 1 serving as an upper die. For example, the cooling mechanism may be provided in either one of the punch 1 and the die 2, or may be provided in both of the punch 1 and the die 2.

Further, the cooling mechanism may be provided in the die 2 or the punch 1 by combining the configurations explained in the first through fourth exemplary embodiments.

INDUSTRIAL APPLICABILITY

In the exemplary embodiments of the present invention, by increasing the supply pressure of cooling medium with a small supply amount of water from the standby stage, the cooling medium can be ejected from all of the ejection ports of die substantially at the same time at good timing, and also the cooling medium can be ejected easily from the ejection ports onto the boundary surface between the die surface and the formed component. For example, in the case where the metal plate (e.g., the work material) is cooled (e.g., quenched) by using the die in accordance with the present invention, the cooling medium can be ejected efficiently onto the metal plate (work material), so that quenching can be performed efficiently, and therefore a formed component having high strength can be obtained.

Further, there can be provided a die in which the cooling medium can be supplied efficiently to the metal plate that is hot press-formed and the maintenance of the mechanism for supplying the cooling medium can be accomplished easily, a forming apparatus equipped with the die, and a forming method using the die.

The foregoing merely illustrates the exemplary principles of the present invention. Various modifications and alterations to the described embodiments will be apparent to those skilled in the art in view of the teachings herein. It will thus be appreciated that those skilled in the art will be able to devise numerous modification to the exemplary embodiments of the present invention which, although not explicitly shown or described herein, embody the principles of the invention and are thus within the spirit and scope of the invention. All publications, applications and patents cited above are incorporated herein by reference in their entireties.

What is claimed is:

1. A hot forming die which is configured to press-form a heated steel plate and to cool the heated steel plate by ejecting a cooling medium onto the heated steel plate when the heated steel plate is held on the die, the hot forming die comprising:

a main supply path configured to facilitate the cooling medium to pass there through;

a plurality of branch supply paths extending from the main supply path and including ejection ports which open at a forming surface of the die, and which are configured to eject the cooling medium; and at least one nozzle member fixed on a part of an ejection port side of each of the branch supply paths and configured to restrict a passage amount of the cooling medium via a passage hole which facilitates the cooling medium to pass there through, wherein the at least one nozzle member is arranged in the branch supply path, and an end face on the ejection port side of the at least one nozzle member is located far from the forming surface of the die, wherein the end face on the ejection port side of the at least one nozzle member and the forming surface of the die is distanced by at least 0.05 mm and at most 50 mm, and wherein a cross-sectional area of a passage hole in the at least one nozzle member is smaller than the cross-sectional area of the branch supply.

2. The hot forming die according to claim 1, wherein the at least one nozzle member has a threaded part which is structured to engage with a threaded part provided in a region on an ejection port side of the branch supply path.

3. The hot forming die according to claim 1, wherein the at least one nozzle member forcibly contacts an inner surface of the branch supply path via an elastic deformation thereof.

4. The hot forming die according to claim 1, wherein the at least one nozzle member is fixed to the branch supply path by at least one of welding or bonding thereto using an adhesive.

5. A press forming apparatus, comprising:

a first die and a second die used in combination with the first die, wherein at least one of the first die or the second die includes a hot forming die which is configured to press-form a heated steel plate and to cool the heated steel plate by ejecting a cooling medium onto the heated steel plate when the heated steel plate is held on the die, the hot forming die comprising:

a main supply path configured to facilitate the cooling medium to pass there through, a plurality of branch supply paths extending from the main supply path and including ejection ports which open at a forming surface of the die, and which are configured to eject the cooling medium, and at least one nozzle member fixed on a part of an ejection port side of each of the branch supply paths and configured to restrict a passage amount of the cooling medium via a passage hole which facilitates the cooling medium to pass there through; and a pressurizing arrangement configured to control a pressure of a cooling medium in the main supply path and the branch supply paths of the hot forming die at least two stages;

wherein the at least one nozzle member is arranged in the branch supply path, and an end face on the ejection port side of the at least one nozzle member is located far from the forming surface of the die, wherein the end face on the ejection port side of the at least one nozzle member and the forming surface of the die is distanced by at least 0.05 mm and at most 50 mm, and wherein a cross-sectional area of a passage hole in the at least one nozzle member is smaller than the cross-sectional area of the branch supply path.

6. A hot press forming method comprising a. press-forming a heated steel plate and cooling the heated steel plate by ejecting a cooling medium onto the heated steel plate when the heated steel plate is held on the die using a press forming apparatus which includes a first die and a second die used in combination with the first die, wherein at least one of the first die or the second die includes a hot forming die which is configured to press-form a heated steel plate and to cool the heated steel plate by ejecting a cooling medium onto the heated steel plate, the hot forming die comprising:

a main supply path configured to facilitate the cooling medium to pass there through, a plurality of branch supply paths extending from the main supply path and including ejection ports which open at a forming surface of the die, and which are configured to eject the cooling medium, and at least one nozzle member fixed on a part of an ejection port side of each of the branch supply paths and configured to restrict a passage amount of the cooling medium via a passage hole which facilitates the cooling medium to pass there through, and wherein the press forming apparatus further includes a pressurizing arrangement configured to control a pressure of a cooling medium in the main supply path and the branch supply paths of the hot forming die at least two stages;

wherein the at least one nozzle member is arranged in the branch supply path, and an end face on the ejection port side of the at least one nozzle member is located far from the forming surface of the die, wherein the end face on the ejection port side of the at least one nozzle member and the forming surface of the die is distanced by at least 0.05 mm and at most 50 mm, and wherein a cross-sectional area of a passage hole in the at least one nozzle member is smaller than the cross-sectional area of the branch supply path, and b. before the press forming of the heated steel plate, maintaining the cooling medium in the main supply path and the branch supply paths on standby after being pressurized to a degree at which the cooling medium unejected, and further pressurizing the cooling medium to a pressure higher than a pressure at a time of the standby at a predetermined timing at least one of during or after pressing and then ejecting the cooling medium onto a formed metal plate.

* * * * *